US005782291A

United States Patent [19]

Morita

[11] Patent Number: 5,782,291

[45] Date of Patent: Jul. 21, 1998

[54] HEAT EXCHANGER

[75] Inventor: Tomonari Morita, Sawa-gun, Japan

[73] Assignee: Sanden Corporation, Japan

[21] Appl. No.: 652,699

[22] Filed: May 30, 1996

[30] Foreign Application Priority Data

May 30, 1995 [JP] Japan ..... 7-154037

[51] Int. Cl.[6] ..... F28D 1/053; F28F 1/16

[52] U.S. Cl. ..... 165/76; 165/173; 165/183; 228/183

[58] Field of Search ..... 165/76, 173, 183; 228/183

[56] References Cited

U.S. PATENT DOCUMENTS

| | | | |
|---|---|---|---|
| 1,438,596 | 12/1922 | Harding | 165/173 X |
| 2,185,930 | 1/1940 | Simpson et al. | 165/183 X |
| 5,048,602 | 9/1991 | Motohashi et al. | 165/173 |

FOREIGN PATENT DOCUMENTS

| | | | |
|---|---|---|---|
| 1431 | 10/1877 | United Kingdom | 165/183 |
| 112666 | 1/1918 | United Kingdom | 165/183 |

*Primary Examiner*—Allen J. Flanigan
*Attorney, Agent, or Firm*—Baker & Botts, L.L.P.

[57] ABSTRACT

The present invention is directed to a heat exchanger. The heat exchanger comprises a pair of header tanks and a plurality of pipe members connecting the pair of header tanks in fluid communication. Each of the pipe member includes a pair of fin portions which diametrically project from an outer peripheral surface thereof. The fin portion extends along the longitudinal axis of the pipe member. The pipe member further includes a pair of limiting elements which are formed at a top and bottom end portions of the pipe member, respectively. One of the pair of limiting elements limits an insertion of the top end portion of the pipe member into a bottom portion of the upper header tank, so that no boundary contact line is created between the top end of the fin portions and the lower surface of the bottom portion of the upper header tank. Similarly, the other limiting element limits an insertion of the bottom end portion of the pipe member into a top portion of the lower header tank, so that no boundary contact line is created between the bottom end of the fin portion and the upper surface of the top portions of the lower header tank. As a result, the pipe members and the header tanks are finely brazed to each other.

10 Claims, 5 Drawing Sheets

HEAT EXCHANGER

FIELD OF THE INVENTION

This invention generally relates to a heat exchanger, and more particularly, to a heat exchanger functioning as an evaporator of an automotive air conditioning system.

BACKGROUND OF THE INVENTION

Heat exchangers as illustrated in FIG. 1 are well known in the art. With reference to FIG. 1, the conventional heat exchanger 10' includes an upper and lower header tanks 11 and 12 which are vertically spaced from each other, and a plurality of circular pipe members 13 which provide fluid communication between the upper and lower header tanks 11 and 12. Furthermore, the heat exchanger 10' may be employed as an evaporator of an automotive air conditioning system.

The upper header tank 11 is rectangular parallelepiped in shape, and therefore, includes a top portion 111, a bottom portion 112 and a sidewall portion 113 which connects the top and bottom portions 111 and 112. Sidewall portion 113 includes a pair of first side regions **113*a* each having a first longitudinal length, and a pair of second side regions 113*b* each having a second longitudinal length which is shorter than the first longitudinal length. The pair of first side regions 113*a* are parallel to each other, and the pair of second side regions 113*b*** are also parallel to each other.

Similarly, the lower header tank 12 is rectangular parallelepiped in shape, and therefore, includes a top portion 121, a bottom portion 122 and a sidewall portion 123 which connects the top and bottom portions 121 and 122. The top and bottom portions 121 and 122 of the lower header tank 12, and the top and bottom portions 111 and 112 of upper header tank 11 are identical in size. Sidewall portion 123 includes a pair of first side regions **123*a* each having the first longitudinal length, and a pair of second side regions 123*b* each having the second longitudinal length. The pair of first side regions 123*a* are parallel to each other, and the pair of second side regions 123*b*** are also parallel to each other.

The upper header tank 11 further includes a rectangular partitioning plate member 15 which may be fitted to and centrally disposed within the upper header tank 11 in an upright orientation. Plate member 15 may be arranged to be parallel to the pair of second side regions **113*b*. Thus, an inner hollow space 110 of the upper header tank 11 is divided into a first chamber section 110*a* and a second chamber section 1 10b by partitioning plate member 15**.

A first circular opening 21 may be centrally formed at one of the pair of the second side regions **113*b* of the sidewall portion 113 of the upper header tank 11 at the location corresponding to the first chamber section 110*a*. A second circular opening (not shown) is centrally formed at the other of the pair of the second side regions 113*b* of the sidewall portions 113 of the upper header tank 11 at a location corresponding to the second chamber section 110*b*. One end of an inlet pipe 31 may be fitted to be received within the first circular hole 21 so as to provide fluid communication between the first chamber section 110*a* of the inner hollow space 110 of the upper header tank 11 and an external element of a refrigerant circuit of the automotive air conditioning system, such as, for example, a condenser (not shown). Similarly, one end of an outlet pipe 32 may be fitted to be received within the second circular hole so as to provide fluid communication between the second chamber section 110*b* of the inner hollow space 110 of the upper header tank 11** and the other external element of the refrigerant circuit, such as, for example, a refrigerant compressor (not shown).

As illustrated in FIG. 2, each of pipe members 13 includes a pair of fin portions 131 which diametrically project from an outer peripheral surface of the pipe member 13. The fin portions 131 may be flat and straight and may be arranged to be aligned with a plane located on the longitudinal axis of the pipe member 13. The pair of fin portions 131 extend along the longitudinal axis of the pipe member 13. As illustrated in FIG. **4*a*, an upper end 131*a* of each of fin portions 131 of the pipe member 13 may be flat and perpendicular to the longitudinal axis of the pipe member 13. The upper end 131*a* of each of fin portions 131 of the pipe member 13 terminates at a position which is slightly lower than an upper end of the pipe member 13. Similarly, a lower end (not shown) of each of fin portions 131 of the pipe member 13 may be flat and perpendicular to the longitudinal axis of the pipe member 13. The lower end of each of fin portions 131 of the pipe member 13 terminates at a position which is slightly higher than a lower end of the pipe member 13**.

With reference to FIG. 1 again, the pipe members 13 may be arranged to form a plurality of rows which are parallel to both the pair of first side regions **113*a* of the sidewall portion 113 of the upper header tank 11 and the pair of first side regions 123*a* of the sidewall portion 123 of the lower header tank 12. The pipe members 13 may further be arranged such that the pair of fin portions 131 thereof are also parallel to both the pair of first side regions 113*a* of the sidewall portion 113 of the upper header tank 11 and the pair of first side regions 123*a* of the sidewall portion 123 of the lower header tank 12**.

A plurality of circular holes **112*c* (shown in FIGS. 4*a* and 4*b*) may be formed through the bottom portion 112 of the upper header tank 11 so as to fit and receive an upper end portion of the corresponding pipe members 13. Each circular hole 112*c* may have a diameter designed to be about equal to or slightly larger than an outer diameter of the pipe members 13. Similarly, a plurality of circular holes 121*c* corresponding to the circular holes 1 12c of the upper header tank 11 may be formed through the top portion 121 of the lower header tank 12 so as to fit and receive a lower end portion of the corresponding pipe members 13**.

With reference to FIGS. **4*a* and 4*b*, in the process of temporarily assembling the heat exchanger 10', the top end portion of the pipe member 13 may be inserted into the corresponding circular hole 1 12c until the upper end 131*a* of the pair for the fin portions 131 comes in contact with a lower surface of the bottom portion 112 of the upper header tank 11. Thus, the length of the top end portion of the pipe member 13 inserted into the upper header tank 11 may be controlled. The bottom end portion of the pipe member 13 may be inserted into the corresponding circular holes 121*c* in a similar manner. When the heat exchanger 10' is temporarily assembled, boundary contact lines 131*b* are created between the upper end 131*a* of the fin portion 131 and the lower surface of the bottom portion 112 of the upper header tank 11. One end of boundary contact lines 131*b* is linked to a lower circumference 112*d* of the circular hole 112*c***.

The upper and lower header tanks 11 and 12 are prepared from a plate member 50 having a clad construction as illustrated in FIG. 3. With reference to FIG. 3, the plate member 50 includes a core metal element 51 and a pair of brazing metal sheets 52 affixed to both side surfaces of the core metal element 51. Alternatively, one brazing metal sheet 52 may be affixed to either one or the other side surface of the core metal element 51. Material of the core metal element 51 and material of brazing metal sheets 52 are selected such that a melting point of the core metal element 51 is sufficiently higher than a melting point of the brazing metal sheets 52. Accordingly, the core metal element 51 is made of, for example, aluminum alloy of the AA3000 system and the pair of brazing metal sheets 52 are made of, for example, aluminum alloy of the AA4000 system. Specifically, the melting point of the core metal element 51 may have a value in the range of about 643° C. to about 654° C., and the melting point of the brazing metal sheets 52 may have a value in the range of about 574° C. to about 632° C. The rectangular plate member 15 also has a clad construction similar to that of the upper and lower header tanks 11 and 12.

On the other hand, the pipe members 13 are made of, for example, aluminum alloy of the AA1000 system. Material of the pipe members 13 is selected such that the melting point thereof is sufficiently higher than the melting point of the brazing metal sheets 52. Specifically, the melting point of the pipe members 13 may have a value in the range of about 646° C. to about 657° C. Furthermore, the silicon content of the aluminum alloy of the AA4000 system is sufficiently larger than that of the aluminum alloys of the AA1000 system and the AA3000 system. The inlet and outlet pipes 31 and 32 may be made of a similar material as that of pipe members 13.

All of the upper and lower header tanks 11 and 12, the pipe members 13, the rectangular plate member 15, and inlet and outlet pipes 31 and 32 are fixedly brazen to one another at their mating surfaces to form a good seal. This brazing process is carried out in a brazing furnace (not shown) after the heat exchanger 10' is temporarily assembled as described above.

Furthermore, in general, the heat exchanger 10' is installed such that the pair of fin portions 131 of the pipe members 13 are oriented to be parallel to the flow direction of the air which passes across the heat exchanger 10' as indicated by the large arrow "A" in FIG. 1.

An operation of the above constructed heat exchanger 10' is described in detail below with reference to FIG. 1. The refrigerant flowing from one external element of the refrigerant circuit, for example, the condenser (not shown) is conducted into the first chamber section 110*a* of the inner hollow space 110 of the upper header tank 11 through the inlet pipe 31. The refrigerant flowing into the first chamber section 110*a* of the inner hollow space 110 of the upper header tank 11, then flows in a dispersed fashion downward through a first group of the pipe members 13, which provides fluid communication between the first chamber section 110*a* of the inner hollow space 110 of the upper header tank 11 and a first volume 120*a* of an inner hollow space 120 of the lower header tank 12. The refrigerant, flowing downward in a dispersed fashion through the first group of the pipe members 13, flows into the first volume 120*a* of the inner hollow space 120 of the lower header tank 12. During the downward dispersed flow through the first group of pipe members 13, the refrigerant in pipe members 13 exchanges heat with the air which passes across the heat exchanger 10' as indicated by the large arrow "A" in FIG. 1, through the fin portions 131 of the pipe members 13. In this heat exchanging operation, the heat of the air is absorbed by the refrigerant so that the refrigerant is vaporized, and the air is cooled.

The refrigerant flowing into the first volume 120*a* of the inner hollow space 120 of the lower header tank 12 flows to a second volume 120*b* of the inner hollow space 120 of the lower header tank 12. The refrigerant flowing into the second volume 120*b* of the inner hollow space 120 of the lower header tank 12 then flows upward in a dispersed manner through a second group of the pipe members 13 which provides fluid communication between the second chamber section 110*b* of the inner hollow space 110 of the upper header tank 11 and the second volume 120*b* of the inner hollow space 120 of the lower header tank 12. The refrigerant, in its upward dispersed flow through the second group of the pipe members 13, flows into the second chamber section 110*b* of the inner hollow space 110 of the upper header tank 11, and then is conducted to the other external element of the refrigerant circuit, such as, for example, the refrigerant compressor (not shown) through the outlet pipe 32. In its upward and dispersed flow through the second group of pipe members 13, the refrigerant in pipe members 13 again exchanges heat with the air, which passes across the heat exchanger 10' as indicated by the large arrow "A" in FIG. 1, through the fin portions 131 of the pipe members 13. In this heat exchanging operation, the heat of the air is again absorbed by the refrigerant so that the refrigerant is vaporized, and the air is cooled.

In a manufacturing process of the conventional heat exchanger 10', the temporarily assembled heat exchanger 10' is transported from a temporarily assembling line to the brazing furnace (not shown) so as to perform the brazing process therein. When the brazing process starts, the temperature in the brazing furnace begins to rise so that the temporarily assembled heat exchanger 10' is heated. When the temperature in the brazing furnace rises to a first value equal to the melting point of the brazing metal sheets 52, the brazing metal sheets 52 begin to melt. The greater part of the melted brazing metal is conducted to the periphery of the mating surfaces between the elements constituting the heat exchanger 10', such as the upper header tank 11 and the pipe member 13. Then, the melted brazing metal conducted to the periphery of the mating surfaces seeps in between the mating surfaces.

In particular, a part of the melted brazing metal may be smoothly and continuously conducted to the lower circumferences 112*d* of the circular hole 112*c* of the upper header tank 11 along the boundary contact lines 131*b*, which are created between the upper end 131*a* of the fm portion 131 and the lower surface of the bottom portion 112 of the upper header tank 11, by virtue of a capillary action generated at the boundary contact lines 131*b*. However, the amount of melted brazing metal which is conducted to the lower circumference 112*d* of the circular hole 112*c* of the upper header tank 11 along the boundary contact lines 131*b* is not constrained in that region.

Therefore, the excessive amount of the melted brazing metal which is conducted to the lower circumference 112d of the circular hole 112*c* of the upper header tank 11 along the boundary contact lines 131*b*, overflows downward along the boundary lines 131*c* created between the outer peripheral surface of the pipe member 13 and a basal end of the fin portion 131.

When the heat exchanger 10' is removed from the brazing furnace (not shown) so as to terminate the brazing process, the brazing metal which seeped into the mating surfaces between the elements constituting the heat exchanger 10', such as the upper header tank 11 and the pipe member 13 becomes solidified. Thus, the mating surfaces are sufficiently fixedly connected to each other. At the same time, the melted brazing metal which overflowed along the boundary lines 131*c* to a certain position becomes solidified. This solidification of the brazing metal at the boundary lines 131*c* provides a rugged and unappealing external appearance on the finished heat exchanger 10'. Moreover, the air which flows through an intervening space between the adjacent pipe members 13 may be partially resisted by the overflow brazing material, thus making the heat exchanging operation of the heat exchanger 10' more inefficient.

In addition, when the melted brazing metal of silicon rich aluminum alloy flows along the boundary lines 131*c* of the pipe member 13 of silicon poor aluminum alloy, atoms of silicon of the brazing metal diffuse through the aluminum which forms the base metal of the aluminum alloy pipe member 13. As a result, defective apertures may be formed through the pipe member 13 due to erosion, so that unexpected leakage of the refrigerant from the pipe member 13 may occur during operation of the automotive air conditioning system.

SUMMARY OF THE INVENTION

Accordingly, it is an object of the present invention to eliminate the rugged and unappealing external appearance of a heat exchanger.

It is another object of the present invention to eliminate an unnecessary decrease in air flow through adjacent pipe members.

It is still another object of the present invention to prevent defective formation of apertures through a pipe member caused by erosion.

In order to achieve the above objects, a heat exchanger according to the present invention includes an upper header tank and a lower header tank spaced from the upper header tank. Each of the upper and lower header tanks comprises a top end portion, a bottom end portion spaced from the top end portion, and a sidewall portion connecting the top and bottom end portions, so that a hollow space is defined within each of the upper and lower header tanks.

A plurality of pipe members provide fluid communication between the upper and lower header tanks. Each of the pipe members comprises at least one fin portion formed at an exterior surface thereof and has a top end and a bottom end opposite to the top end. The at least one fin portion extends along the longitudinal axis of the pipe member and has a top end and a bottom end opposite to the top end. The top end of the at least one fin portion may be spaced from the top end of the pipe member so that a top end region is defined therebetween along the pipe member. The bottom end of the at least one fin portion may be spaced from the bottom end of the pipe member so that a bottom end region is defined therebetween along the pipe member.

A preventing device, such as a pair of annular ridges may be formed at the top and bottom end regions of the pipe member, respectively, so that a line contact between the top end of the at least one fin portion and the bottom portion of the upper header tank and a line contact between the bottom end of the at least one fin portion and the top portion of the lower header tank may be prevented when the top and bottom end regions of the pipe member are inserted into the upper and lower header tanks, respectively.

DETAILED DESCRIPTION OF THE PREFERRED EMBODIMENTS

FIGS. 5, 6, 7, 8, 9, 10 and 11 illustrate a heat exchanger in accordance with several embodiments of the present invention. In FIG. 5 to FIG. 11, the same numerals are used to denote the corresponding elements shown in FIG. 1 to FIG. 4 so that an explanation thereof is omitted. Furthermore, a manner of inserting a top end portion of pipe member 13 into an upper header tank 11 will be described. It should be appreciated that the manner of inserting a bottom end portion of pipe member 13 into a lower header tank 12 may be similar.

Figure 6A:
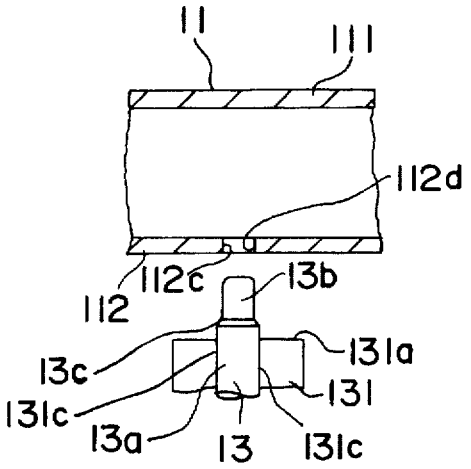
FIGS. 6*a* and 6*b* illustrate a manner of connecting a top end portion of a pipe member to an upper header tank shown in FIG. 5.
Figure 6B:
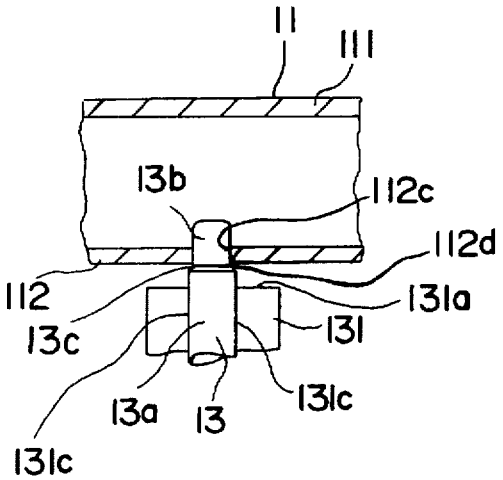

With reference to FIGS. 6*a* and 6*b*, according to a first embodiment of the present invention, each of the pipe members 13 includes a large diameter portion 13*a*, a small diameter portion 13*b* which extends from a top end of the large diameter portion 13a, and a tapered connecting portion 13*c* which may be formed as a boundary between the large diameter portion 13*a* and the small diameter portion 13*b*. An outer diameter of the small diameter portion 13*b* of the pipe member 13 may be designed to be about equal to or slightly smaller than a diameter of each of circular holes 112*c* which may be formed through the bottom portion 112 of the upper header tank 11. A lower periphery of the tapered connecting portion 13*c* may be arranged to be located at a position which may be higher than the upper end 131*a* of the pair of fm portions 131 of the pipe member 13.

Accordingly, as illustrated in FIG. 6*b*, heat exchanger 10 may be temporarily assembled as follows. The entire small diameter portion 13*b* of the pipe member 13 may be snugly inserted into the corresponding circular hole 112*c* until an upper periphery of the tapered connecting portion 13*c* comes in contact with a lower circumference 112*d* of the corresponding circular hole 112*c*. Thus, the length of the top end portion of the pipe member 13 which is inserted into the upper header tank 11 may be readily controlled.

According to the first embodiment, when the heat exchanger 10 is temporarily assembled, a space is maintained between the upper end 131*a* of the fin portion 131 and the lower surface of the bottom portion 112 of the upper header tank 11. Therefore, a boundary contact line is not created between the upper end 131*a* of the fin portion 131 and the lower surface of the bottom portion 112 of the upper header tank 11.

As a result, during the brazing process, the capillary action which permits the smooth and continuous conduction of part of the melted brazing metal to the lower circumference 112*d* of the circular hole 112*c* of the upper header tank 11 is substantially prevented. Therefore, an insufficient amount of melted brazing metal is conducted to the lower circumference 112*d* of the circular hole 112*c* of the upper header tank 11 to cause overflow onto boundary contact lines 131*c* created between the outer peripheral surface of the pipe member 13 and a basal end of the fin portions 131.

When the heat exchanger 10 is removed from the brazing furnace (not shown) at the end of the brazing process, the brazing metal which seeped into the mating surfaces between the elements constituting the heat exchanger 10, such as the upper header tank 11 and the pipe member 13, becomes solidified. Therefore, the mating surfaces are sufficiently fixedly connected to each other. At the same time, because there has been no overflow of brazing material onto boundary lines 131*c*, no brazing metal solidifies at the boundary lines 131*c*. Accordingly, the finished heat exchanger 10 does not exhibit any solidified brazing metal at the boundary lines 131*c* and therefore, the finished heat exchanger has a smooth and desirable external appearance. Furthermore, additional air flow resistance through the intervening space between the adjacent pipe members 13 is not created and thus heat exchanger 10 may effectively perform during the operation of the automotive air conditioning system.

In addition, because the melted brazing metal does not flow along the boundary contact lines 131*c* from the lower circumference 112*d* of the circular hole 112*c* during the brazing process, diffusion of atoms of silicon of the brazing metal through the aluminum, which is the base metal of the aluminum alloy pipe member 13, may be effectively prevented. As a result, the formation of the defective apertures through the pipe member 13 caused by erosion is effectively prevented, so that unexpected leakage of refrigerant from the pipe members 13 during operation of the automotive air conditioning system may be effectively prevented.

Figure 7A:
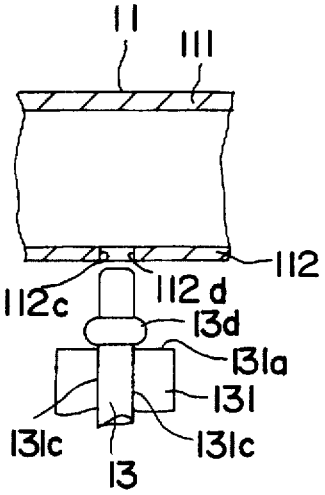
FIGS. 7*a* and 7*b* illustrate a manner of connecting a top end portion of a pipe member to an upper header tank of a heat exchanger in accordance with a second embodiment of the present invention.
Figure 7B:
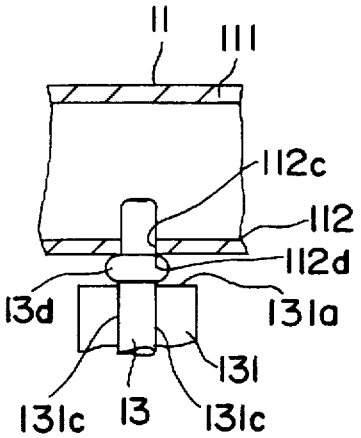

With reference to FIGS. 7*a* and 7*b*, according to a second embodiment of the present invention, each of the pipe members 13 includes an annular bulged portion 13*d* formed at an outer peripheral surface of the top end portion of the pipe member 13. The bulged portion 13*d* may be arranged such that a lower periphery thereof is located at a position which is higher than the upper end 131*a* of the pair of fin portions 131.

Accordingly, as illustrated in FIG. 7*b*, in a process of temporarily assembling the heat exchanger 10, the top end portion of the pipe member 13 may be inserted into the corresponding circular hole 112*c* until an upper periphery of the bulged portion 13*d* comes in contact with the lower circumference 112*d* of the corresponding circular hole 112*c*. Thus, the length of the top end portion of the pipe member 13 which is inserted into the upper header tank 11 may be readily controlled.

Figure 8A:
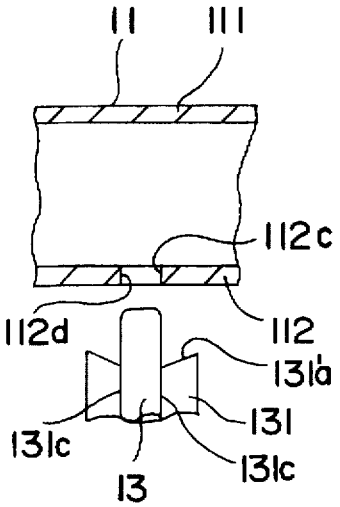
FIGS. 8*a* and 8*b* illustrate a manner of connecting a top end portion of a pipe member to an upper header tank of a heat exchanger in accordance with a third embodiment of the present invention.
Figure 8B:
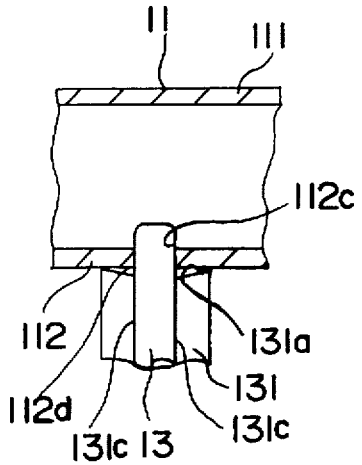

With reference to FIGS. 8*a* and 8*b*, according to a third embodiment of the present invention, each of the pair of fm portions 131 of the pipe member 13 may include an inclined upper end 131'*a* which is inclined inwardly. Accordingly, as illustrated in FIG. 8*b*, in a process of temporarily assembling the heat exchanger 10, the top end portion of the pipe member 13 may be snugly inserted into the corresponding circular hole 112*c* until an outer top edge of the inclined upper end 131'*a* of the pair of fin portions 131 of the pipe member 13 comes in contact with the lower surface of the bottom portion 112 of the upper header tank 11. Thus, the length of the top end portion of the pipe member 13 which is inserted into the upper header tank 11 may be readily controlled.

According to this embodiment, no boundary contact line is substantially created between the upper end 131'*a* of the fin portion 131 and the lower surface of the bottom portion 112 of the upper header tank 11. As a result of having no substantial boundary contact line, during the brazing process, the capillary action which permits smooth and continuous conduction of part of the melted brazing metal to the lower circumference 112*d* of the circular hole 112*c* of the upper header tank 11 may be substantially prevented. Without a substantial capillary action, the flow of brazing metal, in a manner similar to other embodiments, may be controlled as discussed in detail above.

In these embodiments, the fin portions 131 may be integrally formed at the outer peripheral surface of the pipe member 13 by, for example, drawing. Alternatively, the fin portions 131 and the pipe member 13 may be prepared in separate manufacturing processes, respectively, and then they may be fixedly secured to each other by means of any securing manner.

Figure 9:
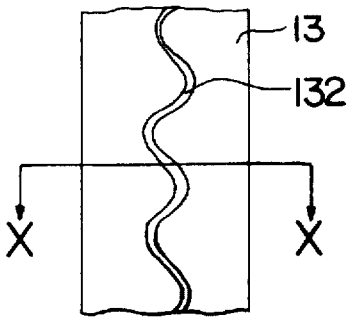
FIG. 9 is a side view of a part of a pipe member of a heat exchanger in accordance with a fourth embodiment of the present invention.
Figure 10:
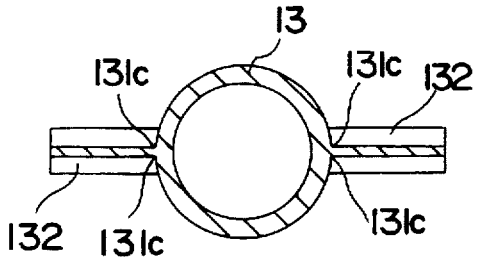
FIG. 10 is a cross sectional view taken on line x—x of FIG. 9.

Furthermore, in the present invention, the configuration of the fin portions of the pipe member is not restricted to that as illustrated in FIGS. 6 to 8. The fin portions having a configuration as illustrated in FIGS. 9 and 10 may be employed in the heat exchanger 10. With reference to FIGS. 9 and 10, a pair of corrugated fin portions 132 diametrically project from an outer peripheral surface of the pipe member 13 and are arranged to be generally aligned with a plane comprising the longitudinal axis of the pipe member 13.

Figure 11:
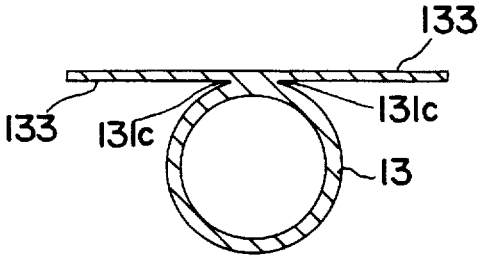
FIG. 11 is a lateral cross sectional view of a pipe member of a heat exchanger in accordance with a fifth embodiment of the present invention.

Still furthermore, in the present invention, the location of the fm portions of the pipe member is not restricted to that as illustrated in FIGS. 6–8. For example, the fin portions may be located at the outer peripheral surface of the pipe member as illustrated in FIG. 11. With reference to FIG. 11, a pair of flat fin portions 133 diametrically project from one portion of the outer peripheral surface of the pipe member 13.

Figure 1:
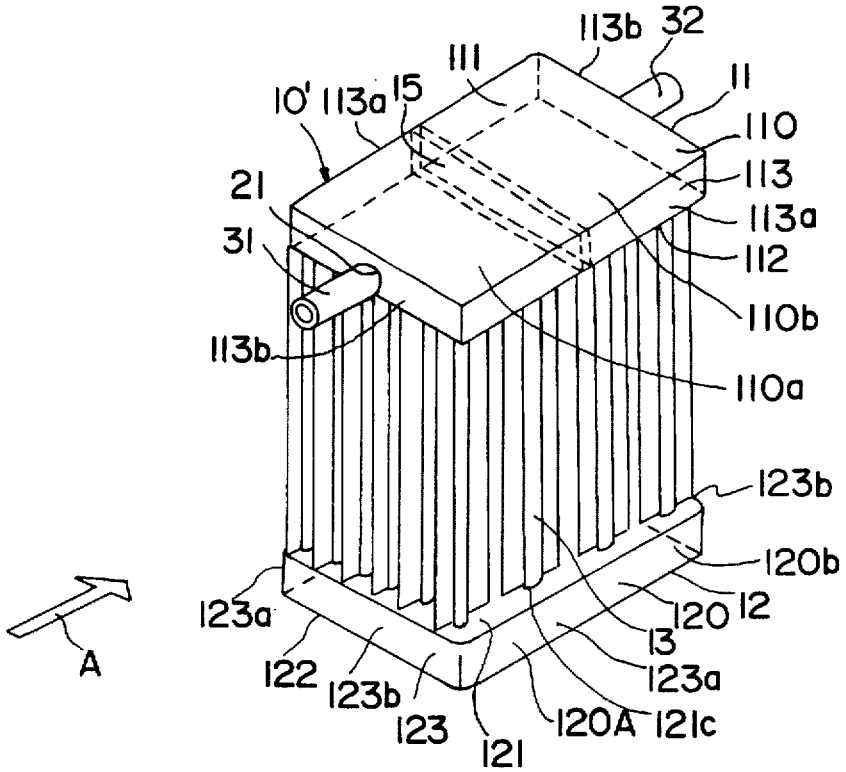
FIG.1 PRIOR ART
FIG. 1 is an overall perspective view of a heat exchanger in accordance with one prior art embodiment.
Figure 2:
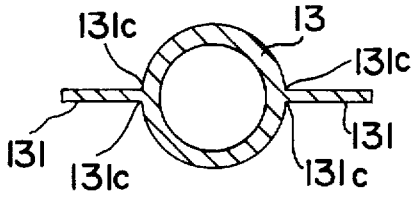
FIG.2 PRIOR ART
FIG. 2 is a lateral cross sectional view of a pipe member shown in FIG. 1.
Figure 3:
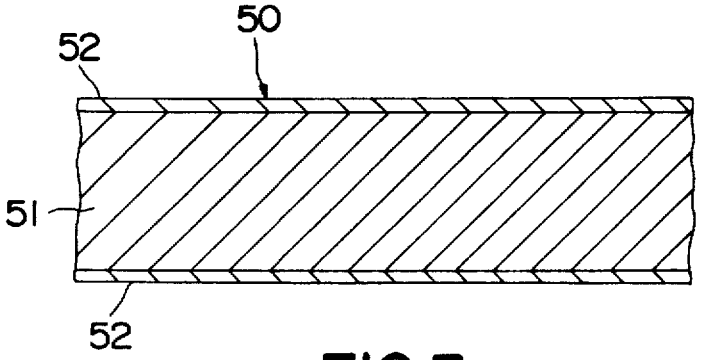
FIG.3 PRIOR ART
FIG. 3 is an enlarged partial longitudinal cross sectional view of a plate member from which the header tanks shown in FIG. 1 are prepared.
Figure 4A:
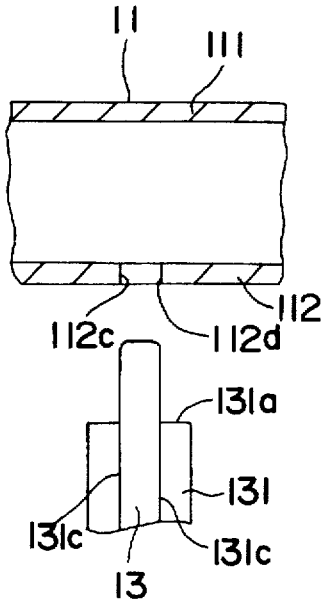
FIG.4A PRIOR ART
FIGS. 4*a* and 4*b* illustrate a manner of connecting a top end portion of the pipe member to the upper header tank shown in FIG. 1.
Figure 4B:
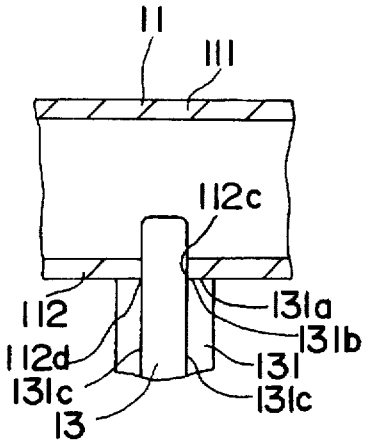
FIG.4B PRIOR ART
Figure 5:
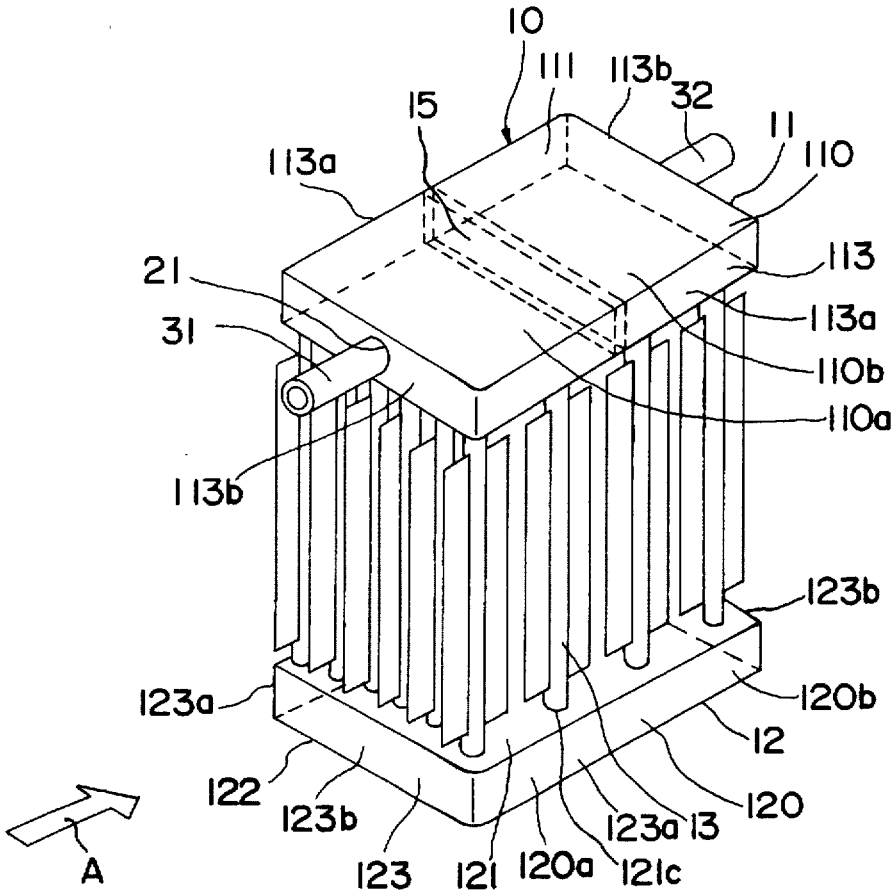
FIG. 5 is an overall perspective view of a heat exchanger in accordance with a first embodiment of the present invention.

Moreover, the pipe members 13 may be arranged in any other configuration including the configuration as illustrated in FIG. 1.

The other features and effects of these embodiments are substantially similar to others disclosed.

This invention has been described in detail in connection with several embodiments. These embodiments, however, are merely provided for example only and the invention is not restricted thereto. It will be understood by those skilled in the art that other variations and modifications can be easily made within the scope of this invention as defined by the appended claims.

What is claimed is:

1. A heat exchanger comprising:

a first header tank and a second header tank spaced from the first header tank, wherein each of the first and second header tanks comprises a top end portion, a bottom end portion spaced from the top end portion, and a sidewall portion connecting the top and bottom end portions, so that a hollow space is defined within each of the first and second header tanks, wherein said bottom end portion of said first header tank has a plurality of holes adapted to accept a plurality of pipe members and wherein said top end portion of said second header tank has a plurality of holes adapted to accept said plurality of pipe members and wherein each of said holes has a circumference;

said plurality of pipe members connecting the first and second header tanks in fluid communications, wherein each of the pipe members comprises at least one fin portion formed at an exterior surface thereof and has a first end and a second end opposite to the first end; and wherein the at least one fin portion extends along the longitudinal axis of the pipe member and has a first end and a second end opposite to the first end; and wherein the first end of the at least one fin portion is spaced from the first end of the pipe member so that a first end region is defined therebetween along the pipe member and the second end of the at least one fin portion is spaced from the second end of the pipe member so that a second end region is defined therebetween along the pipe member; and preventing means for preventing a line contact between the first end of the at least one fin portion and the circumference of the hole in which the pipe member is inserted and a line contact between the second end of the at least one fin portion and the circumference of the hole in which the pipe member is inserted, when the first and second end regions of the pipe member are inserted into the holes of said first and said second header tanks) respectively, wherein said preventing means includes each of the first and second ends of the at least one fin portion which is radially inwardly inclined from the axial ends of the tube towards the axial center of said tube.

2. The heat exchanger of claim 1 wherein each of the pipe members comprises a pair of fin portions which diametrically project from the exterior surface of the pipe member and are arranged to be substantially aligned with a plane containing a longitudinal axis of the pipe member.

3. The heat exchanger of claim 2 wherein each of the fin portions has a plane surface.

4. The heat exchanger of claim 2 wherein each of the fin portions has a corrugated surface.

5. The heat exchanger of claim 1 wherein said preventing means includes an annular ridge formed at each of the first and second regions of the pipe member.

6. The heat exchanger of claim 5 wherein the annular ridge is tapered.

7. The heat exchanger of claim 5 wherein each of the first and second ends of the at least one fin portion is flat.

8. The heat exchanger of claim 1 wherein said preventing means includes an annular bulged portion formed at each of the first and second regions of the pipe member.

9. The heat exchanger of claim 8 wherein each of the first and second ends of the at least one fin portion is flat.

10. The heat exchanger of claim 1 wherein each of the first and second header tanks is rectangular parallelepiped in shape.

* * * * *